US005274923A

United States Patent [19]

Vassallucci et al.

[11] Patent Number: 5,274,923

[45] Date of Patent: Jan. 4, 1994

[54] CUTTING APPARATUS

[75] Inventors: André Vassallucci, Marseilles, France; Osamu Saito, Kanagawa, Japan

[73] Assignee: KM Cloth Cutting Machine Co., Ltd., Kanagawa, Japan

[21] Appl. No.: 891,415

[22] Filed: May 29, 1992

[30] Foreign Application Priority Data

May 31, 1991 [JP] Japan ..... 3-155238

[51] Int. Cl.[5] ..... B26B 7/00

[52] U.S. Cl. ..... 30/275; 30/273

[58] Field of Search ..... 30/275, 273; 83/478, 83/544, 860, 936, DIG.; 188/167; 200/61.85; 307/328; 361/179

[56] References Cited

U.S. PATENT DOCUMENTS

| | | | |
|---|---|---|---|
| 1,283,895 | 11/1918 | Read | 30/275 |
| 1,678,989 | 7/1928 | Maimin | 30/275 |
| 2,293,021 | 8/1942 | Morando | 30/275 |
| 4,325,186 | 4/1982 | Creton | 30/275 |
| 4,698,910 | 10/1987 | Gundlach | 30/275 |
| 4,712,303 | 12/1987 | Barrett | 30/275 |

FOREIGN PATENT DOCUMENTS

| | | | |
|---|---|---|---|
| 2619789 | 11/1977 | Fed. Rep. of Germany | 30/275 |

*Primary Examiner*—Richard K. Seidel
*Assistant Examiner*—Hwei-Siu Payer
*Attorney, Agent, or Firm*—Levisohn, Lerner & Berger

[57] ABSTRACT

A cutting apparatus comprising a cutting blade arranged along a pole pendent from a motor portion, a press rod having a cloth press attached to the lower end thereof, which is vertically movably arranged at a front part of the cutting blade, and a brake disposed to confront the press rod for controlling the vertical movement of the press rod, wherein a guard covering the cutting blade is attached to the press rod, a handle is provided with a lever to be actuated when the handle is gripped, a switch of the motor portion to be actuated by the operation of the lever is connected to open and close the brake, and a power source is separately arranged.

6 Claims, 6 Drawing Sheets

CUTTING APPARATUS

BACKGROUND OF THE INVENTION

The present invention relates to a cutting apparatus having a safety device.

There is known a cutting apparatus for cutting a large quantity of a cloth, which has a structure where a vicinity of this handle 9 so that the release lever 8 is manipulated by the hand gripping the handle 9. Reference numeral 10 represents a driving switch 10 which also is operated by the hand gripping the handle 9.

In this structure, the bed 2 is slipped between a table and piled layers of cloth placed on the table, and the cloth is spread on the bed 2 and the brake 7 is released by the release lever 8 to move the press rod 5 and make the height of the cloth press 6 in agreement with the height of the cloth, whereby the cloth just in front of the cutting blade 4 is pressed for the cutting operation.

In this state, the driving switch is turned on and the cutting blade 4 is applied to the part, to be cut, of the cloth, and the cutting operation is thus carried out.

PROBLEM TO BE SOLVED BY THE INVENTION

The above-mentioned structure includes the following states.

(1) A sharp cutting blade is always exposed.

(2) Once the driving switch is turned on, the cutting blade continues a high-speed reciprocating movement even if a worker separates his hand from the handle, unless the driving switch is turned off.

(3) In the case where power failure is caused in the state where the driving switch is turned on and turning-off of the driving switch is forgotten, if power failure is released and electric power is supplied again, the cutting blade begins the high-speed reciprocating movement again abruptly.

Each of these three states is very dangerous, and it is an object of the present invention to eliminate these dangerous states.

It is an object of the present invention to prevent an unforeseen accident by covering the cutting blade automatically while the operator separates his hand from the handle.

Another object of the present invention is to prevent an unforeseen accident by stopping the motion of cutting blade automatically while the operator separates his hand from the handle.

Still another object of the present invention is to prevent an unforeseen accident by preventing the cutting blade to drive even if the driving switch is ON when the power becomes ON.

SUMMARY OF THE INVENTION

In accordance with the present invention, there is provided a cutting apparatus comprising a cutting blade arranged along a pole pendent from a motor portion, a press rod having a cloth press attached to the lower end thereof, which is vertically movably arranged at a front part of the cutting blade, and a brake disposed to confront the press rod for controlling the vertical movement of the press rod, wherein a guard covering the cutting blade is attached to the press rod, a handle is provided with a lever to be actuated when the handle is gripped, a switch of the motor portion to be actuated by the operation of the lever is connected to open and close the brake, and a power source is separately arranged.

According to the above-mentioned structure, when the handle is gripped, the press rod is braked and simultaneously, the switch is turned on, and the power source switch is turned on and cutting becomes possible. When the hand is separated from the handle, the press rod descends and the cutting blade is covered by the guard and simultaneously, the switch is turned off and driving of the cutting blade is stopped. Furthermore, even if power failure is caused in the state where the switch is turned on and this turn-on state is kept, the cutting blade does not begin the movement again abruptly on release of the power failure.

DETAILED DESCRIPTION OF THE PREFERRED EMBODIMENTS

One embodiment of the present invention will now be described in detail with reference to the accompanying drawings.

Figure 1:
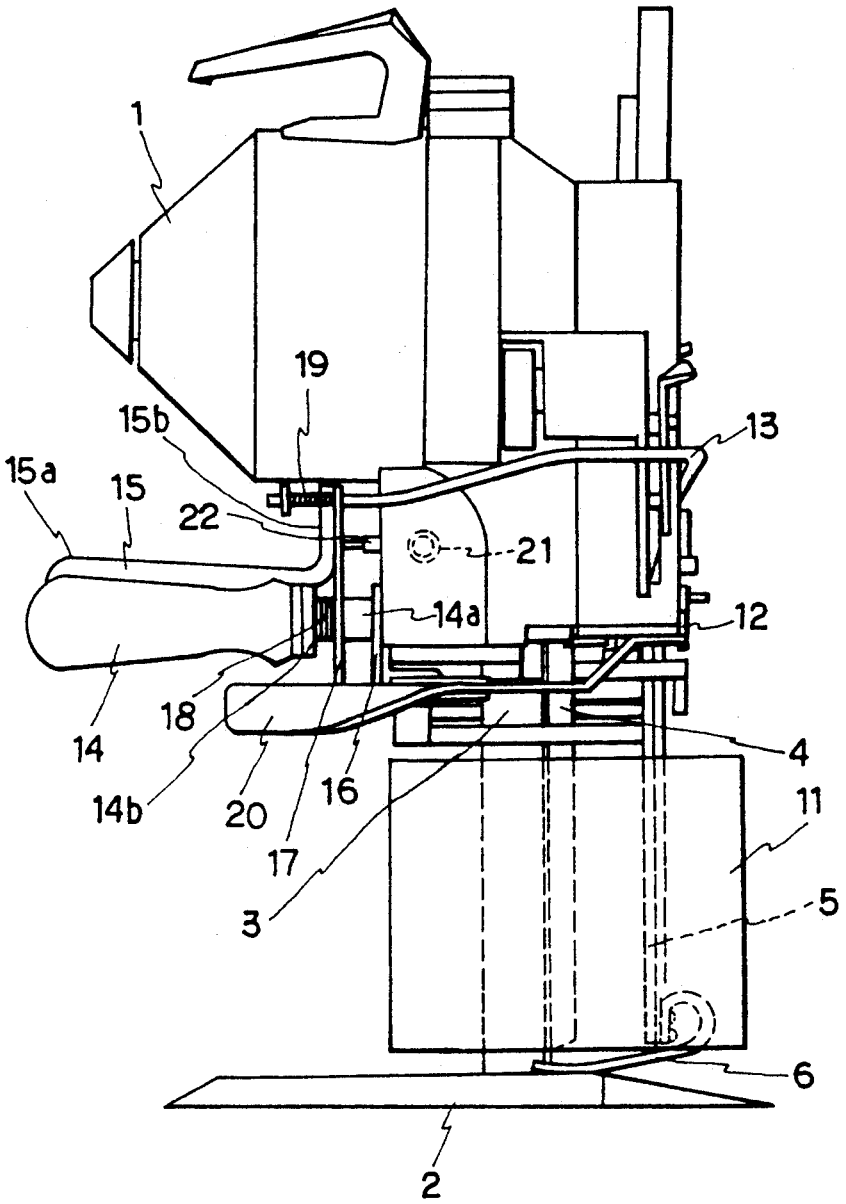
FIG. 1 is a side view showing the entire structure of an embodiment.
Figure 2:
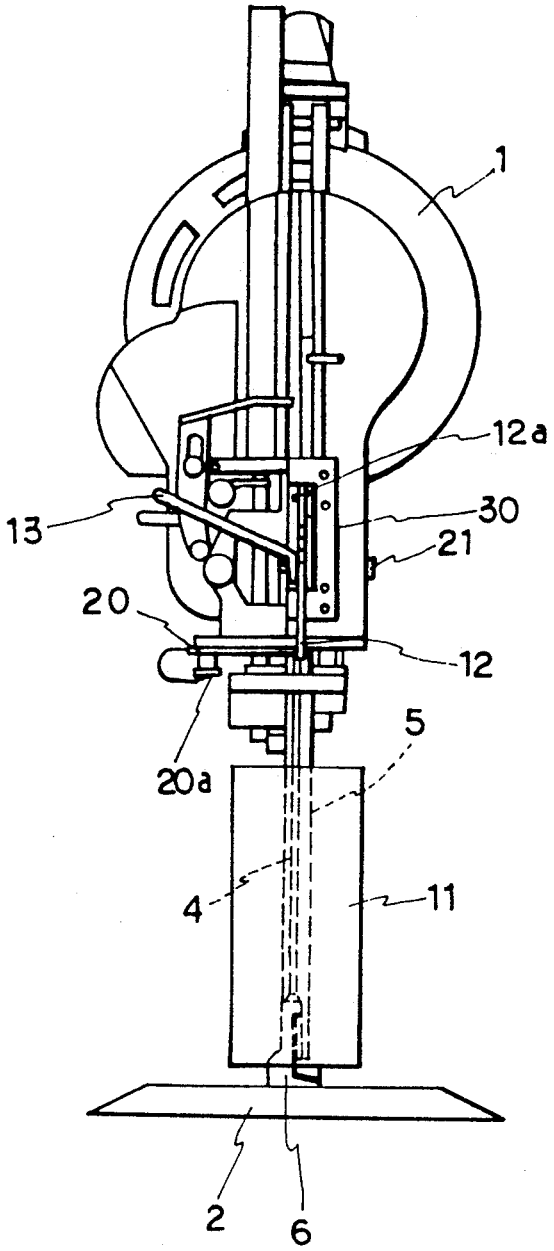
FIG. 2 is a front view illustrating the entire structure.
Figure 3:
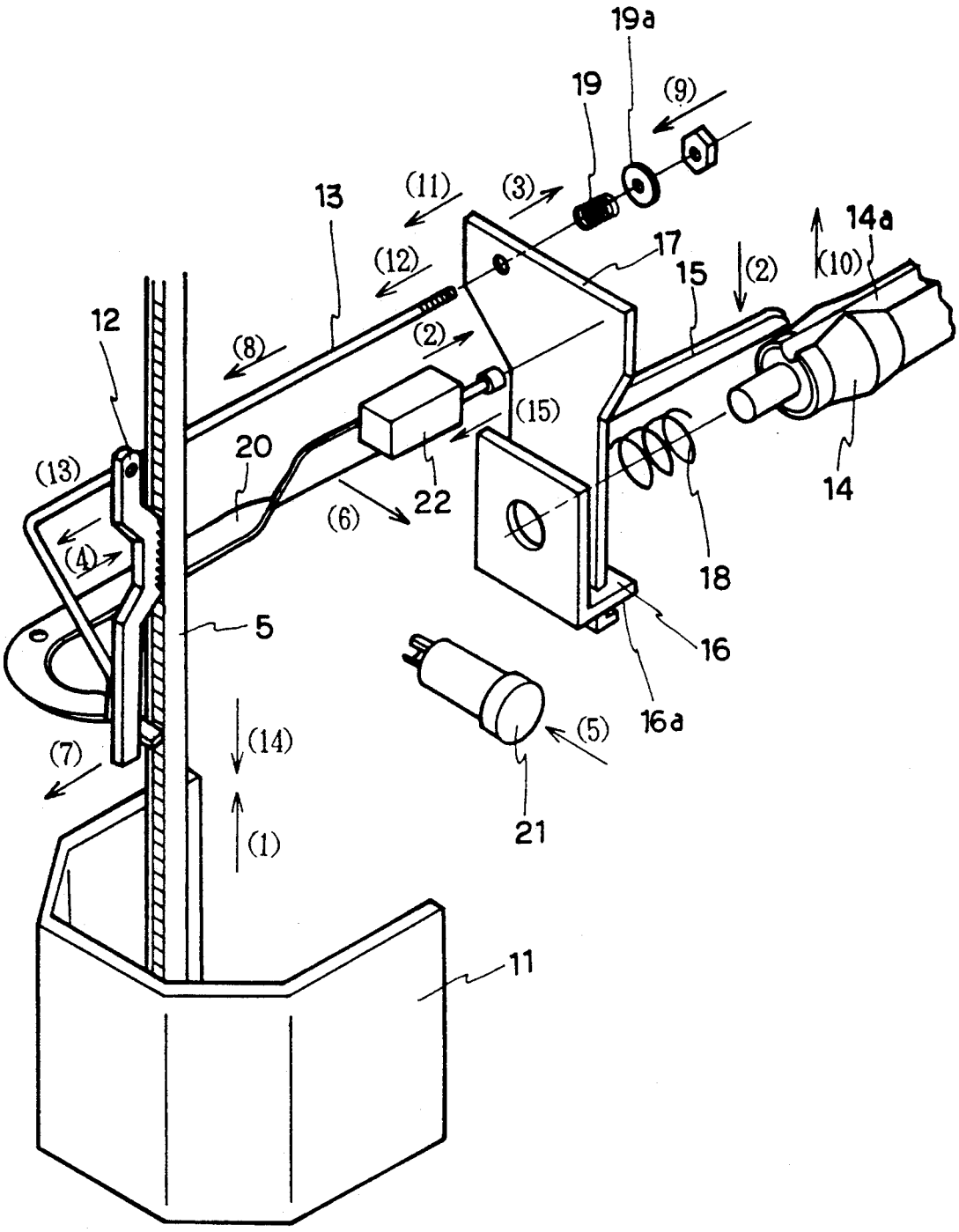
FIG. 3 is a diagram illustrating a main part.
Figure 4:
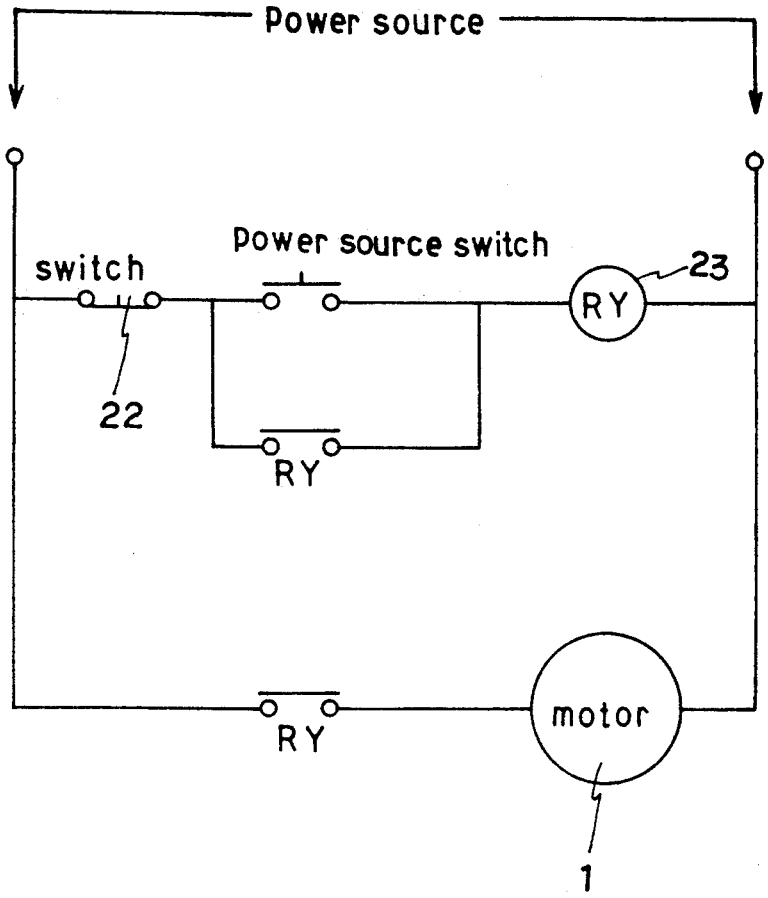
FIG. 4 is an electric circuit diagram.
Figure 5:
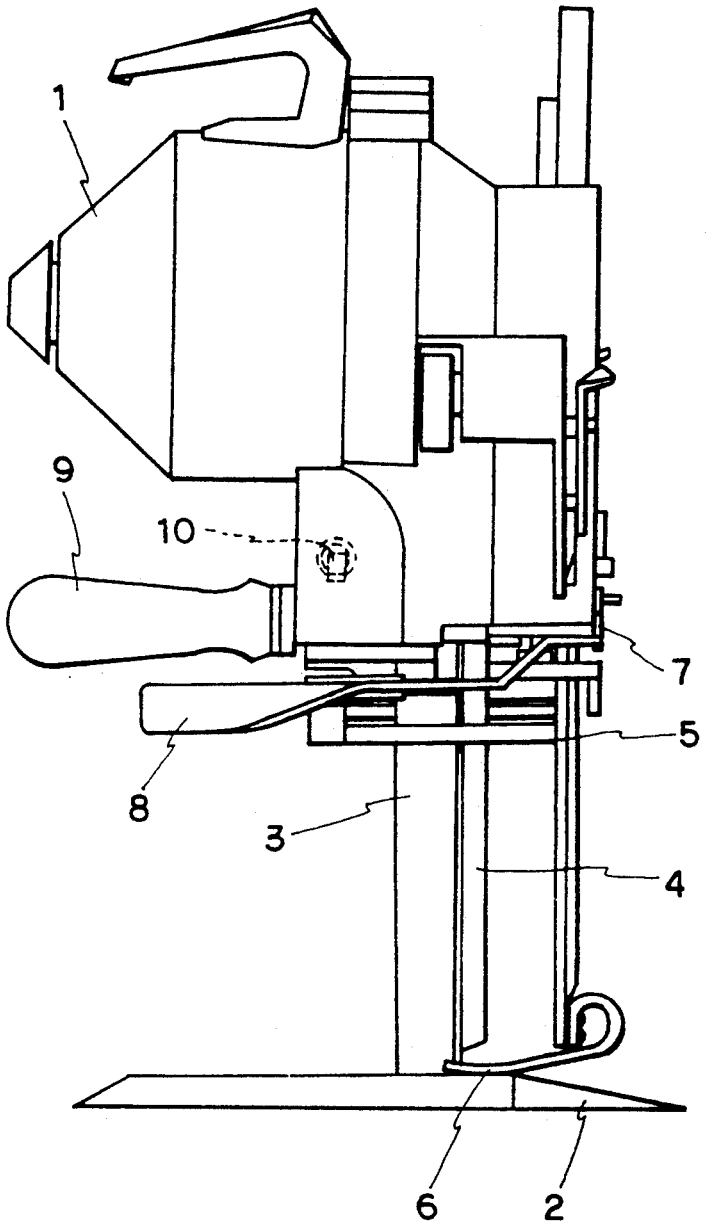
PRIOR ART Fig. 5
FIG. 5 is a side view showing the entire structure of the conventional apparatus.
Figure 6:
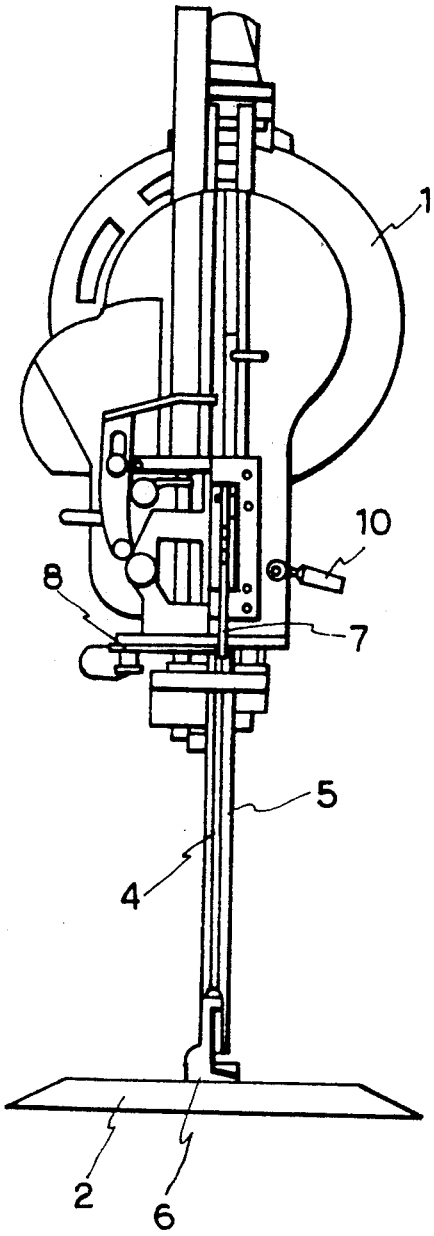
PRIOR ART Fig. 6
FIG. 6 is a front view showing the entire structure of the conventional apparatus.

FIG. 1 is a side view of the entire structure, FIG. 2 is a front view of the entire structure, FIG. 3 is a diagram illustrating a main part, and FIG. 4 is an electric circuit diagram.

In the drawings, reference numerals 1, 2 and 3 represent a motor portion, a bed and a pole, respectively, and the motor portion 1 is set on the bed 2 by the pole 3. Furthermore, a cutting blade 4 is arranged along the pole 3.

Reference numeral 5 represents a press rod 5 which moves vertically along the pole 3 and a cloth press 6 is attached to the lower end of the press rod 5. These members are the same as those described above with respect to the conventional technique.

A guard having a section having a shape opened in one direction, such as a U-figured shape or semi-ellipsoidal shape, is attached to the press rod 5 so that the front and side portions of the cutting blade 4 are surrounded by the peripheral surface of the guard 11.

Reference numeral 12 represents a brake supporting this press rod 5, and the brake 12 is disposed to maintain the cloth press 6 at a desired height as in the above-mentioned conventional technique. The top end of the brake 12 is rotatably or pivotably supported to the housing 30 at aperture **12*a* of the apparatus and the lower end of an operating shaft 13 is fixed to the lower portion of the brake 12**.

Reference numeral 14 represents a handle attached to the housing of the apparatus, and a groove **14*a* extending in the longitudinal direction is formed on the handle 14. A lever 15 is arranged slidably along this groove 14*a* at its leftward end along an elongated section 15*a* (See FIGS. 1 and 3). Lever 15 also has a leg 15*b* which is at right angles to section 15*a* (see FIG. 1). The top end of this lever 15 is connected to a swinging member 17 having a lower end swingably arranged on a surface 16*a* of a plate 16 attached to the apparatus proper or housing 30 in front of the handle 14, whereby the above-mentioned operation is made possible. A spring 18 is disposed between the swinging member 17 and a front grip portion 14***b* of the handle 14 to press and urge the swinging member 17 forward. The rear end of the operation shaft 13 is connected to this swinging member 17 through a spring 19, whereby the lever 15 is connected to the operation shaft 13 through the swinging member 17 and the brake 12 connected to the top end of the operation shaft 13 is urged in the direction separating from the press rod 5 by the elastic force of the spring. In the normal state, no pressing force is applied to the press rod 5 by the brake 12 and the cloth press 6 attached to the lower end of the press rod 5 is brought down on the bed 2. The spring 19 is arranged so that the operation shaft 13 is drawn backward and the spring 19 acts in the direction where the plate 12 impinges against the press rod 5. The elastic force of the spring 19 is weaker than that of the spring 18 and the motion of the swinging member 17 is not substantially influenced by the elastic force of the spring 19.

Reference numeral 20 represents a brake release lever rotatably supported on the housing of the apparatus in the vicinity of the aperture 20*a* shown in the front of lever 20, and the front end of the lever 20 is connected to or impinges against the lower part of the brake 12. The rear end of the lever 20 is extended to the vicinity of the handle 14 so that the lever 20 can be operated by the hand gripping the handle 14. If the rear end of the lever 20 is operated, the brake 12 is rotated against the elastic force of the spring 19 to move the brake 12 in the direction separating from the press rod 5.

Reference numeral 21 represents a power source switch, reference numeral 22 represents a switch and reference numeral 23 represents a relay coil, and an electric circuit for these members is as shown in FIG. 4.

Operations of the cutting apparatus having the above-mentioned structure will now be described.

(1) The press rod 5 provided with the guard 11 is brought up, and (2) the handle 14 is gripped by the other hand, whereby the lever 15 is caused to drop in the groove 14*a* and simultaneously plate 17 pushes against, the switch 22 which is turned on.

(3) The upper part of the swinging member 17 is moved backward against the elastic force of the spring 18. (4) By this movement, the operation shaft 13 is moved leftwardly as in FIG. 1, and the brake 12 brakes the press rod 5, and therefore, the hand supporting the press rod 5 at the operation (1) can be set free.

(5) By turning on the power switch 21 by holding the handle 14, an electric current is caused to flow in the relay coil 23 to attract the contact, and even if the power source 21 is then separated, the electric current, flows through the contact of the relay and therefore, the relay is kept in the self-retention state while the electric current flows to the motor portion 1 through the other contact to drive the cutting blade 4. (6) At this point, the brake release lever 20 is actuated and (7) the brake 12 is released. (8) By this releasing action (7), the operation shaft 13 is drawn forward. (9) By this operation, the spring 19 pressing the operation shaft 13 backward is compressed and the brake release lever 20 is moved in the above-mentioned manner without return of the swinging member 17, and the brake 12 is temporarily released, whereby the press rod 5 is allowed to freely move in the vertical direction and impinge against on the top surface of cloth. Accordingly, the guard 11 and the piled cloth are located in front of the cutting blade 4 and the cutting operation can be performed without exposure of the cutting blade 4.

(10) When the worker separates his hand from the handle 14 during or after the cutting operation, (11) the swinging member 17 is restored by the elastic force of the spring 18 and also the lever 15 is returned.

(12) By return of the swinging member 17, the operation shaft 13 is returned to the front position, and (13) the brake 12 is pressed out forward and is disengaged from the press rod 5, (14) whereby the press rod 5 is set free and the guard 11 is brought down to cover the front part of the cutting blade 4. (15) By the above-mentioned return (11), the switch 22 is turned off to stop the driving of the cutting blade 4.

As is apparent from the foregoing description, in the state where the worker separates his hand from the handle 14, the cutting blade 4 is not driven and the guard 11 covers the front part of the cutting blade 4.

Even if power failure is caused in the state where the handle is gripped by the hand, since the electric current flowing in the relay coil is cut, the self-retention of the coil is released to open the contact, and even if electricity is applied again in this state, the relay coil is not actuated and abrupt driving of the cutting blade 4 can be prevented.

In the foregoing embodiment, the cutting operation is carried out while moving the bed on the table on which cloth is placed. However, in the present invention, there can also be adopted a structure in which the bed is not disposed and the cutting operation is carried out while hanging down the cutting apparatus from above.

As is apparent from the foregoing description, since the present invention provides a cutting apparatus comprising a cutting blade arranged along a pole pendent from a motor portion, a press rod having a cloth press attached to the lower end thereof, which is vertically movably arranged at a front part of the cutting blade, and a brake disposed to confront the press rod for controlling the vertical movement of the press rod, wherein a guard covering the cutting blade is attached to the press rod, a handle is provided with a lever to be actuated when the handle is gripped, a switch of the motor portion to be actuated by the operation of the lever is connected to open and close the brake, and a power source is separately arranged, there can be attained an effect that when the operater's hand is separated from the handle, the press rod is brought down and the guard covers the cutting blade, and therefore the cutting blade is covered while the operater separates his hand from the handle.

Furthermore, when the operater's hand is separated from the handle, the switch is turned off, and therefore, the cutting blade is stopped when the worker separates his hand from the handle.

Still furthermore, in the case where power failure is caused in the state where the switch is turned on and this turn-on state is kept, the cutting blade does not begin the reciprocating movement again even when power failure is released and electricicity is applied again. Therefore, there can be attained an effect of preventing an unforeseen accident.

What is claimed is:

1. A cutting apparatus for cutting large quantities of cloth, the cutting apparatus comprising:

a bed on which said cloth is carried to be cut, a cutting blade and a motor operating said cutting blade, a cloth press for pressing on said cloth prior to its being cut, a vertical pole interconnected between said motor and said bed, a press rod vertically moving along said pole, said cloth press attached to the lower end of said press rod, said press rod having a safety guard, said cloth press being located in front of said cutting blade, a brake means to control the vertical movement of said press rod, said apparatus further comprising means to effectively and safely operate said cutting apparatus comprising a handle means and a lever means, said handle and lever means coupled to operate said brake means and to control the operation of said motor, said brake means releasing said press rod to drop said cloth press on said cloth, said motor controlled by a motor control circuit, said motor control circuit comprising a first manual switch and a second switch coupled to said handle means, motor relay means and motor relay contacts operable to be energized and closed respectively, when said manual switch is switched to a motor operated position, said relay contacts connected in parallel with said manual switch, said manual switch being released to an open position after said motor operates, said relay contacts maintaining the operation of said motor after said manual switch opens, said motor terminating its operation when said second switch is caused to be opened, said motor prevented from restarting when said second switch is closed until said manual switch is closed.

2. A cutting apparatus for cutting large quantities of cloth as claimed in claim 1, wherein said motor comprises a relay coil and said first and second switches are connected in series with said relay coil.

3. A cutting apparatus for cutting large quantities of cloth as claimed in claim 1, wherein said handle means is connected to a plate, said plate bearing on said second switch means, said second switch means moved to an open position when an operator removes his hand from said handle means and moved to a closed position when the operator lifts the handle means to operate the apparatus.

4. A cutting apparatus for cutting large quantities of cloth, the cutting apparatus comprising:

a bed on which said cloth is carried to be cut, a cutting blade and a motor operating said cutting blade, a cloth press for pressing on said cloth prior to its being cut, a vertical pole interconnected between said motor and said bed, a press rod vertically moving along said pole, said press rod attached to the lower end of said pole, said press rod having a safety guard, said cloth press being located in front of said cutting blade, a brake means engaging said press rod to control the vertical movement of said press rod, said apparatus further comprising means to effectively and safely operate said cutting apparatus comprising a handle means, a lever means, said handle and lever means coupled to said brake means and to control said motor, said apparatus further comprising mechanical release means releasing said press rod to drop said cloth press on said cloth;

said mechanical release means comprising a shaft means, the front end of said shaft means coupled to said brake means, biasing spring means biasing said shaft means to cause said brake means to hold said press rod in place while said apparatus operates.

5. A cutting apparatus for cutting large quantities of cloth according to claim 4, wherein said mechanical release means comprises an L-shaped plate, a pivot plate bearing against said L-shaped plate, said pivot plate coupled to said handle means, said pivot plate coupled to said shaft means such that operation of said handle means operates said shaft means and said brake means.

6. A cutting apparatus for cutting large quantities of cloth according to claim 4, wherein said lever means independently operates said brake means to release said brake means.

* * * * *